US009468941B2

(12) United States Patent
Bruder et al.

(10) Patent No.: US 9,468,941 B2
(45) Date of Patent: Oct. 18, 2016

(54) APPLICATOR HEAD FOR A DISPENSER, AS WELL AS A DISPENSER COMPRISING SUCH AN APPLICATOR HEAD

(71) Applicant: APTAR RADOLFZELL GMBH, Radolfzell (DE)

(72) Inventors: Thomas Bruder, Constance (DE); Tobias Baumann, Gottmadingen (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 14/420,794

(22) PCT Filed: Jul. 18, 2013

(86) PCT No.: PCT/EP2013/065178

§ 371 (c)(1),
(2) Date: Feb. 10, 2015

(87) PCT Pub. No.: WO2014/029568

PCT Pub. Date: Feb. 27, 2014

(65) Prior Publication Data

US 2015/0202644 A1 Jul. 23, 2015

(30) Foreign Application Priority Data

Aug. 20, 2012 (DE) ..... 10 2012 214 789

(51) Int. Cl.
*B05B 11/00* (2006.01)

(52) U.S. Cl.
CPC ..... *B05B 11/3047* (2013.01); *B05B 11/0008* (2013.01); *B05B 11/3004* (2013.01);
(Continued)

(58) Field of Classification Search
CPC ..... B05B 11/0008; B05B 11/3043; B05B 11/3074; B05B 11/3047; B05B 11/3004; B05B 11/3064; B05B 11/3077; B05B 11/3015
See application file for complete search history.

(56) References Cited

U.S. PATENT DOCUMENTS 4,084,731 A * 4/1978 Ayres ..... B05B 11/3015 137/512.2
5,388,728 A * 2/1995 Gueret ..... A45D 34/04 222/105

(Continued)

FOREIGN PATENT DOCUMENTS

| | | |
|---|---|---|
| DE | 196 10 457 A1 | 9/1997 |
| EP | 1 160 178 B1 | 12/2001 |
| EP | 2 058 241 A1 | 5/2009 |
| EP | 2 153 908 A1 | 2/2010 |

OTHER PUBLICATIONS

Examination Report of German Patent Office issued in Application No. 10 2012 214 789.6 dated Mar. 21, 2013 (7 pages).

(Continued)

*Primary Examiner* — Frederick C Nicolas
(74) *Attorney, Agent, or Firm* — Flynn, Thiel, Boutell & Tanis, P.C.

(57) ABSTRACT

An applicator head for discharging media from a reservoir, including a housing with a coupling device for coupling to the reservoir, an inlet opening, an applicator opening for discharging medium into a surrounding atmosphere, a conveying device for conveying the medium from the inlet opening to the applicator opening and an actuating handle, movable relative to the housing to actuate the conveying device.

The housing is a one-piece injection molded part formed from two plastics having different properties. The coupling device is constructed of a first of the two plastics. A ring seal surrounds the inlet opening and is arranged to bear tightly against the reservoir when coupled to the applicator head. A venting valve with an aperture which opens in a pressure-dependent manner and through which ambient air flows from the surrounding atmosphere into the reservoir, is constructed of the second of the two plastics.

15 Claims, 3 Drawing Sheets

(52) U.S. Cl.
CPC ..... *B05B11/3043* (2013.01); *B05B 11/3064* (2013.01); *B05B 11/3074* (2013.01); *B05B 11/3077* (2013.01); *B05B 11/3015* (2013.01)

(56) References Cited

U.S. PATENT DOCUMENTS 5,425,476 A * 6/1995 Montaner ..... B05B 11/3011 222/383.1
5,927,559 A 7/1999 Bommer et al.
7,757,900 B2 * 7/2010 Knauer ..... B05B 11/3032 222/207
2006/0231643 A1 10/2006 Laidler et al.
2009/0314811 A1 12/2009 Dennis

OTHER PUBLICATIONS

International Search Report with English translation issued in Application No. PCT/EP2013/065178 dated Oct. 17, 2013 (4 pages).

* cited by examiner

APPLICATOR HEAD FOR A DISPENSER, AS WELL AS A DISPENSER COMPRISING SUCH AN APPLICATOR HEAD

FIELD AND BACKGROUND OF THE INVENTION

The invention relates to an applicator head for a dispenser and also to a dispenser comprising an applicator head of this type.

An applicator head of the type in question comprises a housing with a coupling device for coupling to a reservoir which is used to receive a liquid or paste-like medium, an inlet opening facing the reservoir, and an applicator opening for dispensing the medium into a surrounding atmosphere, a conveyor device for conveying the medium from the inlet opening to the applicator opening, and an actuating handle, which can be moved manually relative to the housing, in order to actuate the conveying device.

Applicator heads of this type and also dispensers comprising such applicator heads are known in general from the prior art. They are used to dispense pharmaceutical media. In particular, they are also used in order to dispense cosmetic creams, lotions and other types of cosmetic media.

Known applicator heads of this type usually have a lot of individual components, which are joined together during an assembly process. This leads to a complicated and costly assembly, depending on the complexity of the applicator head.

SUMMARY OF THE INVENTION

One problem addressed by the invention is that of providing an applicator head that combines high reliability with a simple form of production. A further problem which is addressed is also that of providing a dispenser comprising an applicator head of this type.

In accordance with a first aspect of an applicator head according to the invention, a one-piece seal and valve device, is provided, which has a ring seal region and a venting valve, wherein the ring seal region is arranged on the applicator head in such a way that it bears tightly against the reservoir, in particular against an end face surrounding an outlet opening of the reservoir, once the reservoir has been coupled to the applicator head, and the venting valve is formed by an aperture in the one-piece seal and valve device, which aperture is closed by resilient deformation of the seal and valve device, only with negative pressure on the side of the reservoir.

An applicator head in the sense of this and further variants of the invention is the part of a dispenser that is coupled to the preferably bottle-like reservoir in order to enable the metered discharge of the medium stored in the reservoir. Here, the housing of the applicator head is the part that provides at least the coupling device by means of which the applicator head is connected to the reservoir.

The coupling device of the housing surrounds at least the aforementioned inlet opening, for example a connecting piece, which is provided for the attachment of a riser pipe, said inlet opening being used to guide medium from the reservoir for the purpose of discharge into the applicator head. Furthermore, the applicator head comprises the aforementioned conveying device, which for example can be formed as a piston pump. The conveying device is actuated by means of the actuating handle, which is movable relative to the housing and thus at least relative to the coupling device of the applicator head, and which is used, by means of a manual application of force, in order to perform a discharge process caused by the conveying device.

In accordance with the first aspect, an individual component, which may consist of a uniform plastic, but could also be produced from multi-component injection molding (overmolding), thus performs two functions and is arranged on the applicator head in accordance with these functions. On the one hand, the component has a ring seal region, which approximately has the form of a ring seal, and is arranged between a housing of the applicator head and the reservoir. Here, the ring seal region performs the same functions as a conventional ring seal. However, a one-piece part of the seal and valve device is additionally a venting valve, which is formed completely by the seal and valve device and for this purpose has an aperture therein, which is held closed by the shaping of the seal and valve device in the case of an overpressure in the reservoir or a substantially identical pressure on both sides of the valve and opens with negative pressure in the reservoir.

Here, a component separate from the housing is provided in one embodiment as a seal and valve device, which, during the assembly, has to be coupled to other parts of the applicator head and in particular the housing. Since only an individual component is necessary for this purpose, said component performing both the function of a ring seal and the function of a venting valve, the assembly is facilitated compared with conventional applicator heads. In particular, since soft and resilient plastics are advantageous for both functions, the assembly process can be facilitated without significant disadvantages.

In accordance with a second aspect of an applicator head according to the invention, this is formed alternatively or additionally in such a way that the housing is produced as a one-piece injection molded part from at least two plastics having different properties. Here, the coupling device consists of a first of the mentioned plastics and another portion of the housing consists of the second of the two plastics. The mentioned other portion of the housing may be a ring seal, which surrounds the inlet opening and is arranged in such a way that it bears tightly against the reservoir once the reservoir has been coupled to the applicator head. Additionally or alternatively, the portion produced from the second plastic can form a venting valve with an aperture that opens in a pressure-dependent manner, preferably a slot-shaped aperture, through which ambient air from the surrounding atmosphere can flow into the reservoir. Provided the applicator head has a one-piece seal and valve device, this seal and valve device is formed in one embodiment by the portion produced from the second plastic.

In accordance with the second aspect of the invention, the housing is constructed as a plastic component formed from at least two plastics. This is a one-piece component, of which the different portions formed from different plastics are integrally bonded to one another, in particular by means of the multi-component injection molding (overmolding) production technique. The coupling device and preferably also additionally the predominant part of the housing, in particular the outer surfaces thereof, consists of the first plastic, which in particular is preferably comparatively hard and/or has a high modulus of elasticity. In particular, a ring seal is fabricated from a second plastic, which preferably is softer than the first plastic and/or has a lower modulus of elasticity, said ring seal being the part of the housing surrounding the inlet opening and thus directly producing the desired seal following the coupling of the applicator head to a reservoir, as a result of which seal it is made impossible for liquid to escape in the transition region between the reservoir and the applicator head. The sometimes difficult arrangement of a soft ring seal between the applicator head and the preferably bottle-shaped reservoir during the assembly is hereby spared.

Alternatively or preferably additionally to the ring seal fabricated from the second plastic, a venting valve, which is also a one-piece part of the housing, is preferably fabricated from the second of the two plastics. This venting valve is used to allow ambient air to flow into the reservoir through the applicator head. This inflow of air is necessary in order to prevent a negative pressure from forming in the reservoir with continued discharge of the medium in the medium store. The attachment of such a venting valve as a separate component is also problematic during assembly, such that the direct forming thereof integrally on the housing leads to a significant facilitation of the assembly process.

Both for the ring seal and for the venting valve, it is also true that these have to bear tightly against surrounding components in order to each fulfill their purpose. Due to the one-piece formation with other parts of the housing, this is ensured in a particularly effective manner. In the case of the ring seal between this and further parts of the housing, leakages caused by careless assembly can thus be avoided. In the case of the venting valve, air is effectively prevented from passing the valve and reaching the bottle, and in particular liquid is prevented from reaching a surrounding environment undesirably through the corresponding venting channel.

With regard to the venting valve and the ring seal, the use of a soft and/or particularly resilient plastic is advantageous in the manner already mentioned. For this purpose, TPE (thermoplastic elastomer) is suitable in particular. With regard to the coupling device and most of the other portions of a housing of an applicator head according to the invention, in particular the outer surfaces of the housing accessible to the end user, higher importance is placed on the dimensional stability and suitability thereof for absorbing the assembly forces. These parts therefore preferably consist of a harder plastic, in particular of polypropylene or HDPE (high density polyethylene).

In particular, the venting valve can be formed by a curved and preferably approximately bell-shaped surface, in which the aperture is provided as a slot-shaped aperture. The two surface portions on either side of the slot press shut the slot in a position relieved of pressure and open only in the presence of the aforementioned pressure conditions necessary for this, that is to say the negative pressure in the reservoir.

The housing of the applicator head, as mentioned, provides the coupling device by means of which the applicator head is connected to the reservoir. This coupling device is formed in one embodiment as a detent coupling device, which is intended to be coupled to the neck of the reservoir by engaging behind a widened portion thereof. Another possibility for forming a coupling device is constituted by a threaded coupling device, which is designed to cooperate with a thread on a neck of the reservoir.

As already mentioned, the housing preferably comprises further components besides the aforementioned coupling device, the ring seal and the venting valve and/or a one-piece seal and valve device. Part of the one-piece housing is thus preferably also a guide surface for guiding the actuating handle relative to the housing and/or a cylinder surrounding the pump chamber at least in portions, relative to which cylinder a piston operatively coupled to the actuating handle can move in a sliding manner. The aforementioned additional components are preferably also produced from the first of the specified plastics and thus preferably consist of the same material as the coupling device. The guide surface is a surface of the housing along which the actuating handle is guided in a sliding manner. The actuating handle preferably consists of the first plastic so as to effectively prevent a deformation. The cylinder, which together with the piston forms a pump chamber of the conveying device of which the volume can be varied, is preferably also formed from the first plastic.

In conjunction with the conveying device, it is of relevance to note that the term "piston" and the term "cylinder", which cooperate in order to alter the volume of the pump chamber, are exchangeable in the context of the applicator head described here. Both the piston and the cylinder are preferably formed by cylindrical walls that can be inserted one inside the other, said walls bearing against one another in an annular contact region. It is irrelevant which of these components is referred to as a cylinder and which is referred to as a piston.

In accordance with a development of the invention, the injection molded part, which consists of a plurality of plastics and forms the housing, additionally forms a return spring made of plastic. This return spring is used to return the actuating handle in the direction of the starting position thereof and/or to return a piston of a pump chamber of the conveying device in the direction of an enlargement of the pump chamber, said piston being operatively coupled to the actuating handle and optionally connected in one piece.

Here, the return spring is preferably produced from the second-mentioned plastic or from a third plastic, which has different properties compared with the first two specified plastics. In the case of the shaping in accordance with this development, an even further simplified assembly is made possible by the direct formation of the return spring integrally on the housing. If further valves of the pump chamber are necessary, it is thus possible for the applicator head to have merely two primary components, specifically the housing, which also comprises a venting valve, the ring seal and the spring in a single piece, and an actuating handle coupled thereto.

It is considered to be particularly advantageous if the applicator head is formed in such a way that the return spring is completely relieved of pressure when the actuating handle or the piston is arranged in an end position. It has been found that this complete pressure relief of the return spring can avoid relaxation processes in the plastic of the spring, which, with continued ageing of the applicator head, can cause at least an altered haptic impression of the actuation or can also impair the functional efficiency of the applicator head. Also with a separate plastic spring, which is used in an applicator head of the type in question or according to the invention, it is considered to be advantageous if this spring is relaxed in an end position of the piston or of the actuating handle. This is true in particular for applicator heads in which, due to a radial seal of the pump chamber, there is no need in an unactuated rest position to apply force permanently to the piston in the direction of the rest position.

In accordance with a third aspect, the invention also relates to an applicator head of the type in question, wherein a one-piece component is provided which is produced as an injection molded part from two plastics having different properties, wherein this component on the one hand forms the actuating handle and/or a piston of the conveying device and on the other hand forms a spring acting as a return spring between the actuating handle or the piston and the housing. Here, at least the guide surface provided on the actuating handle for guidance thereof or a slide seal surface of the piston for cooperation with a cylinder of the conveying device is fabricated from a first of the two plastics, and the spring is fabricated from a second of the two plastics. With regard to the first and the second plastic, the same is true as for the plastics mentioned above in conjunction with the first two aspects of the invention. Again, the first plastic is preferably a harder plastic with higher modulus of elasticity, and the second plastic is preferably a softer plastic with lower modulus of elasticity and good resilient properties.

In accordance with this third aspect of the invention, the actuating handle and the return spring provided to return the actuating handle in particular are thus formed in one piece with one another, which in turn enables a facilitated assembly, since the spring, which is only slightly deformable and is therefore difficult to handle, does not have to be handled separately during assembly. Instead, said spring is handled jointly with the actuating handle, which is comparatively rigid at least in portions, or with the piston, which is comparatively rigid at least in portions.

When shaping the spring, there are various possibilities. The spring can be formed as a coil spring. However, it may also be formed as a closed bellows-like spring. A particular advantage is provided if the second of the specified plastics, of which the at least one return spring consists, is also used in the case of an outer surface of the actuating handle. What is known as a soft-touch surface can thus be produced, which is found to be particularly pleasant to the touch.

The spring provided on the inner side of the actuating handle and the soft-touch surface provided on the outer side of the actuating handle are preferably directly interconnected, in particular since a main body of the actuating handle fabricated from the first plastic has apertures, through which the second plastic extends. This facilitates the injection molding process, since the softer plastic only has to be fed at one point.

The invention also relates to a dispenser comprising a preferably bottle-like reservoir and an applicator head, wherein the applicator head is formed in the described manner.

BRIEF DESCRIPTION OF THE DRAWINGS

Further aspects and advantages of the invention will emerge from the claims and also from the following descriptions of preferred exemplary embodiments of the invention, which are explained with reference to the figures, in which:

DETAILED DESCRIPTION

Figure 1:
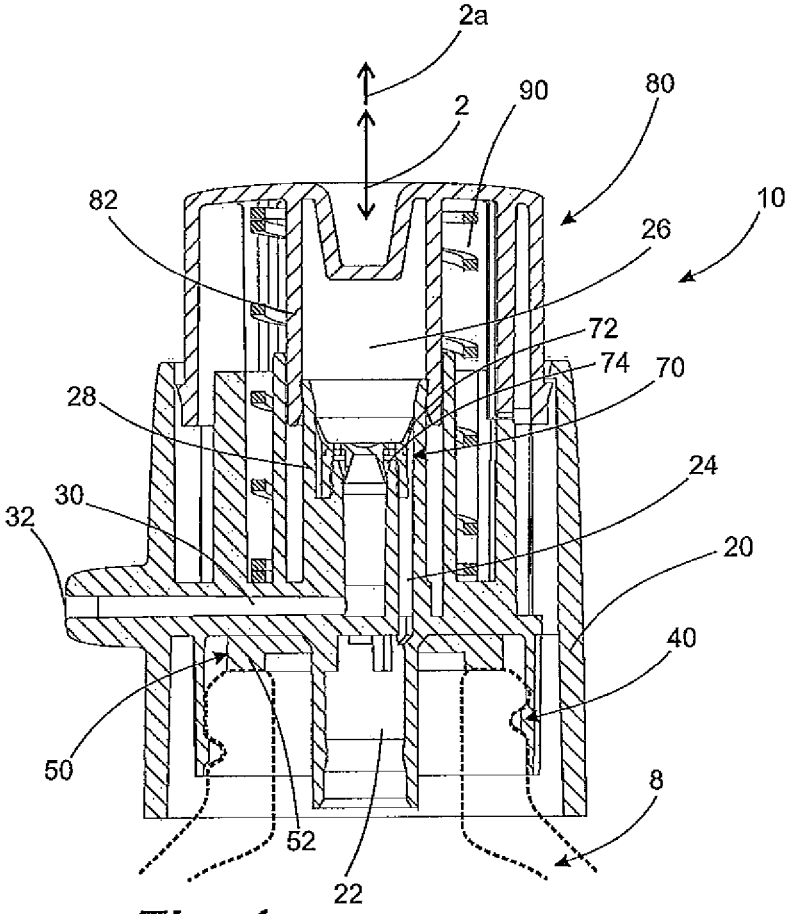
FIGS. 1 and 2 show a first embodiment of an applicator head according to the invention, in each case in a sectional illustration.

With regard to the figures, it should first be mentioned that, in the case of components which are produced from different plastics by means of multi-component injection molding, the different portions of differing material are illustrated in the figures as separate parts, wherein they each have a consistent type of hatching, for example the components 20 and 50 in FIG. 1.

Figure 2:
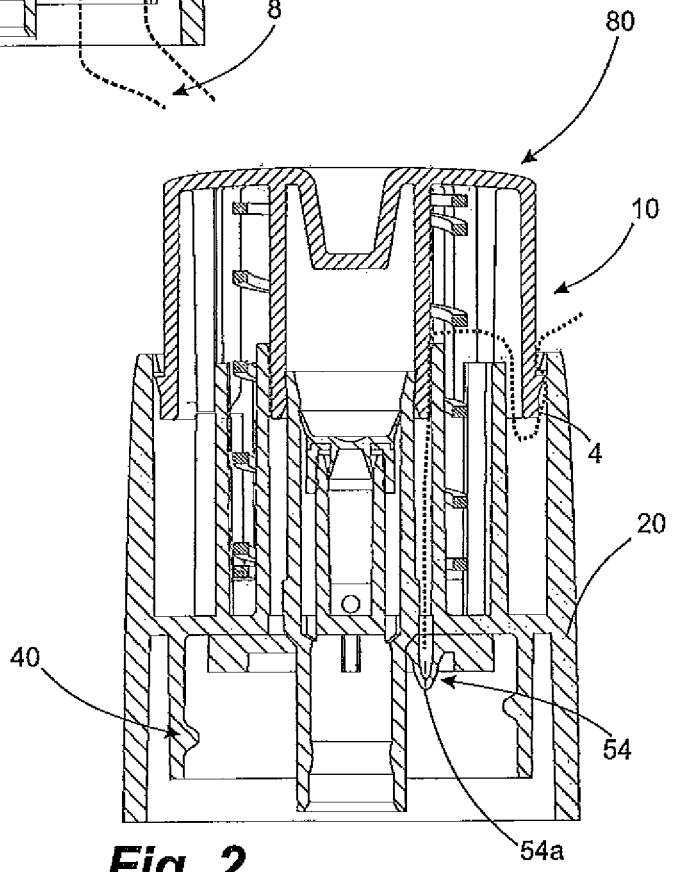

FIGS. 1 and 2 show a first embodiment of an applicator head 10 according to the invention which is intended for attachment to a liquid reservoir 8, indicated in a dashed manner.

The applicator head 10 has a housing 20 and also an actuating handle 80 movable relative thereto in a direction of actuation 2. To convey liquid from the liquid reservoir 8, an inlet opening 22 is provided on the side of the housing 20 facing the liquid reservoir 8, which inlet opening is formed by a connection piece intended for attachment of a riser pipe. From this, a liquid channel 24 extends into a pump chamber 26, of which the volume can be varied by displacement of the actuating handle 80 relative to the housing 20. In order to form the pump chamber, both the housing 20 and the actuating handle 80 have approximately cylindrical walls 28, 82, which bear against one another in a radially sealing manner and form walls of the pump chamber 26. An applicator channel 30, which opens out into an applicator opening 32, adjoins the pump chamber 26. In order to enable a pumping process, a valve component 70 produced by means of two-component injection molding is provided on the housing 20 and provides both an inlet valve 72 and an outlet valve 74. The inlet valve 72 opens with negative pressure in the pump chamber 26 with respect to the liquid reservoir 8. The outlet valve 74 opens with overpressure in the pump chamber with respect to a surrounding atmosphere. A conveying device is thus formed that discharges medium from the pump chamber 26 when the actuating handle 80 is pressed down and that sucks up medium from the medium reservoir 8 as said actuating handle is pressed down.

A coil spring 90 made of plastic is provided between the housing 20 and the actuating handle 80 and can press the actuating handle and therefore also the cylinder surface 82 in the direction 2*a*, that is to say in the direction of the starting position thereof. This spring is formed in such a way that it is fully relieved of pressure in the unactuated state of FIGS. 1 and 2, whereby relaxation processes in the material of the spring are avoided. Only when the actuating handle 80 is actuated is the spring 90 compressed resiliently.

The component 20 forming the housing in particular also forms a coupling device 40 of this housing 20 in the form of an inner thread, by means of which the applicator head 10 is coupled to the liquid reservoir 8.

A further key part of the one-piece housing 20 is a portion 50, which surrounds the inlet connection piece 22 and which is indeed formed in one piece with the other components of the housing 20, but consists of a softer and more flexible plastic at least compared with the coupling device 40. This portion 50 performs two functions. On the one hand, it forms a ring seal region 52, which bears against the bottle neck of the liquid reservoir 8 and which is compressed as a result of the applicator head 10 being screwed onto the liquid reservoir 8 and hereby prevents liquid from escaping in this transition region. On the other hand, the portion 50 forms a bell-shaped venting valve 54, which has a slot-like aperture 54*a*. This venting valve 54 is used for the purpose of allowing air to flow back when there is negative pressure in the reservoir produced by liquid discharge. Here, the valve 54 prevents the corresponding path of the air, which is indicated by the dashed line 4, from allowing liquid to escape in the opposite direction, which is undesirable. Only when there is negative pressure in the liquid reservoir 8 does the venting valve 54 open.

The housing 20 including the portion 50 is produced as a one-piece component from two different plastics by means of multi-component injection molding, in the present case from TPE for the portion 50 and PP or HDPE for all other portions. Due to this one-piece embodiment, the assembly is made easier. In addition, the number of contact points between component parts at which liquid can escape from the liquid reservoir 8 in an unintended manner is reduced.

Figure 3:
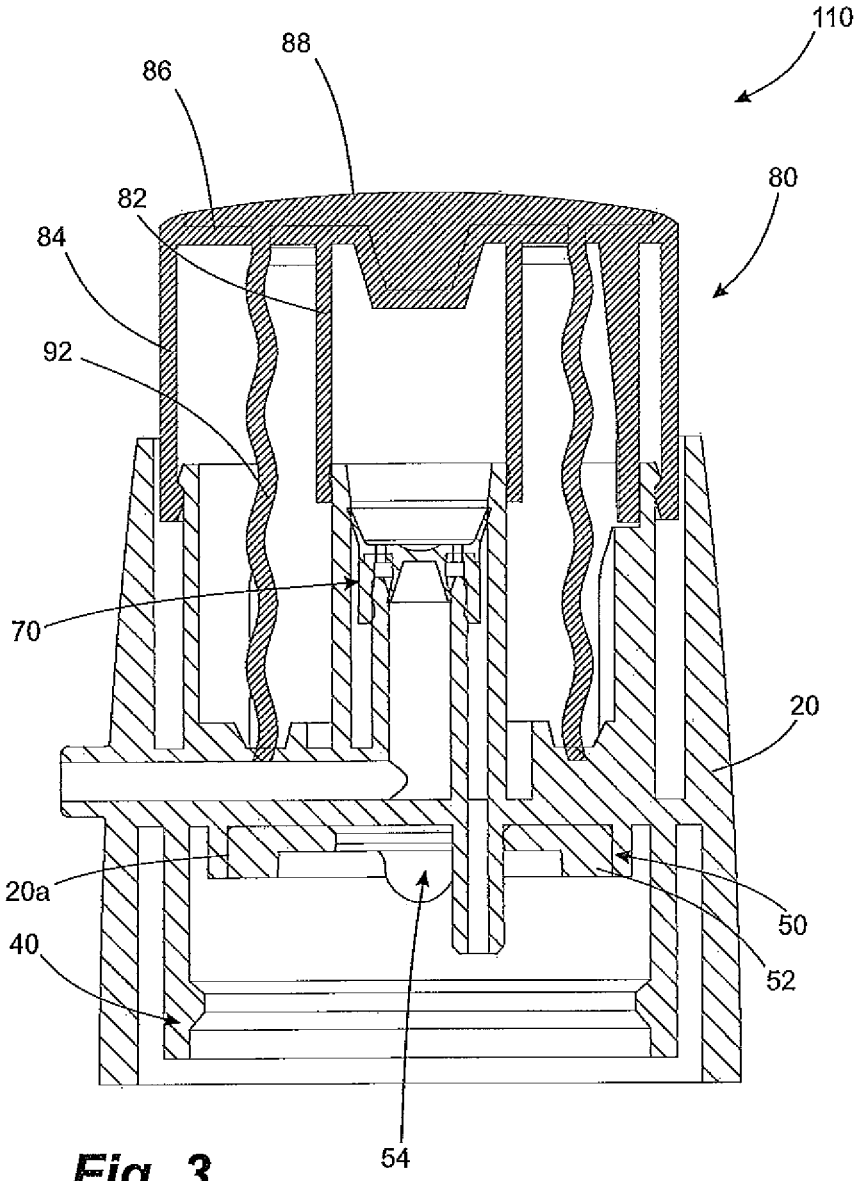
FIG. 3 shows a second embodiment of an applicator head according to the invention in a sectional illustration.

The applicator head 110 of FIG. 3 differs in particular in terms of two aspects from the embodiment of FIGS. 1 and 2.

On the one hand, the portion 50 in this embodiment is not connected in one piece to the housing 20. Instead, it forms a separate component made of a uniform, soft plastic, in particular from TPE, which is arranged in a downwardly open indentation 20*a* of the housing 20 and is held here in a force-locked manner.

However, this portion 50 in turn comprises both a ring seal region 52 and a venting valve 54, which are each constructed in such a way as can be seen from FIGS. 1 and 2. Although the portion 50 is not a one-piece part of the housing 20, a substantial assembly simplification can be attained by the integration of the ring seal and the venting valve in a component. Of course, the housing 20 and the portion 50 nevertheless can be integrally bonded in the form of a single piece in the case of the embodiment of FIG. 2 as well.

The second key difference from the previously described embodiment of FIGS. 1 and 2 lies in the fact that, for facilitated assembly, the return spring 92 and the actuating handle 80 are provided as a common one-piece component. These are also produced in the manner already described by two-component injection molding. Whereas the cylindrical outer wall 84 and also the cylindrical wall 82 associated with the conveying device and an end face 86 connecting these cylindrical walls 82, 84 consist of a hard plastic, in particular of PP or HDPE, the return spring 92, which is formed in the present case in a bellows-like manner purely by way of example, is formed from a softer plastic well suited for a return function, in the present case from LOPE for example. Due to the consolidation in a common component, the assembly of the actuating handle 80 with the integrally formed return spring 92 is facilitated.

A particular advantage results from the fact that the material of the return spring 92 is also used on an outer side 88 of the actuating handle 80. This outer side 88 is directly connected to the return spring 92 by apertures in the end face 86. Due to the use of the soft, resilient material also on the outer side 88, a very pleasant haptic quality is conveyed during actuation.

The entire applicator head 110 of FIG. 3 thus consists only of four components to be joined together during assembly, specifically the housing 20, the seal and valve portion 50, the valve unit 70 and the actuating handle 80 with integrally formed return spring 92.

Figure 4:
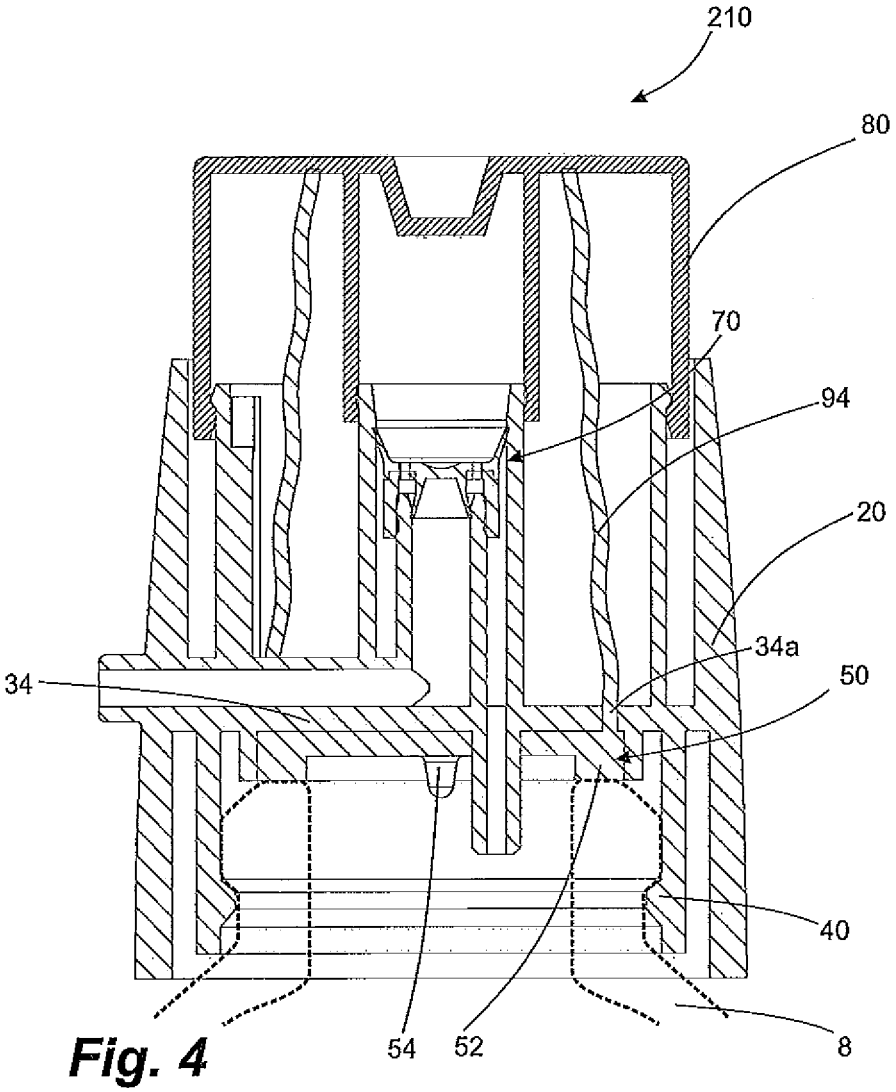
FIG. 4 shows a third embodiment of an applicator head according to the invention in a sectional illustration.

In the case of the applicator head 210 in FIG. 4, the spring 94 also is not formed as a separate component. In contrast to the embodiment of FIG. 3, it is not designed as a one-piece component with the actuating handle 80, but instead is likewise formed in one piece integrally on the housing 20, similarly to the seal and valve portion 50. For this purpose, apertures 34*a* are provided in a transverse wall 34 of the housing 20 facing the liquid reservoir 8, through which apertures the softer material of the ring seal and valve unit 50 extends into the region of the return spring 94 and forms said return spring there. The applicator head 210 of FIG. 4 is thus designed to be composed from just three separate components during the assembly: The housing 20 with seal and valve portion 50 formed integrally in one piece by multi-component injection molding and the spring 94, likewise formed integrally in one piece, the valve unit 70 and the actuating handle 80.

The invention claimed is:

1. An applicator head for coupling to a reservoir for discharging liquid or paste-like medium from the reservoir, the applicator head comprising:

a housing with a coupling device for coupling to the reservoir;

an inlet opening facing the reservoir and an applicator opening for dispensing the medium into a surrounding atmosphere;

a conveying device for conveying the medium from the inlet opening to the applicator opening;

an actuating handle manually movable relative to the housing in order to actuate the conveying device;

a one-piece seal and valve device including a ring seal region and a venting valve, the ring seal region being arranged on the applicator head in such a way that the ring seal region bears tightly against the reservoir once the reservoir has been coupled to the applicator head, the venting valve being formed by a curved surface of the one-piece seal and valve device, the curved surface having a slot-shaped aperture, wherein the slot-shaped aperture is closed by resilient deformation of the one-piece seal and valve device, and the slot-shaped aperture opens only with negative pressure on the side of the reservoir.

2. The applicator head as claimed in claim 1, wherein the coupling device is formed as a detent coupling device designed to engage behind a widened portion on a neck of the reservoir, or the coupling device is formed as a threaded coupling device designed to cooperate with a thread on a neck of the reservoir.

3. The applicator head as claimed in claim 1, wherein the housing additionally comprises:

a guide surface for guiding the actuating handle relative to the housing; and/or a cylinder surrounding a pump chamber and a piston operatively coupled to the actuating handle is movable in a sliding manner relative to the cylinder.

4. The applicator head as claimed in claim 1, wherein a one-piece component is provided and is produced as an injection molded part from two plastics having different properties, wherein the one-piece component:

on the one hand forms the actuating handle and/or a piston of the conveying device, and on the other hand forms a spring acting as a return spring between the actuating handle and/or the piston on the one hand and the housing on the other hand, and wherein at least one guide surface of the actuating handle for guiding the actuating handle relative to the housing and/or at least one slide seal surface of the piston for sealing a pump chamber is fabricated from a first of the two plastics and the spring is fabricated from a second of the two plastics.

5. The applicator head as claimed in claim 4, wherein an outer surface of the actuating handle intended for direct user contact consists of the second of the two plastics.

6. An applicator head for coupling to a reservoir for discharging liquid or paste-like medium from the reservoir, the applicator head comprising:

a housing with a coupling device for coupling to the reservoir;

an inlet opening facing the reservoir and an applicator opening for dispensing the medium into a surrounding atmosphere;

a conveying device for conveying the medium from the inlet opening to the applicator opening;

an actuating handle manually movable relative to the housing in order to actuate the conveying device;

a one-piece seal and valve device including a ring seal and a venting valve, the ring seal surrounding the inlet opening and arranged on the applicator head in such a way that the ring seal bears tightly against the reservoir once the reservoir has been coupled to the applicator head, the venting valve being formed by an aperture in the one-piece seal and valve device, the aperture being closed by resilient deformation of the one-piece seal and valve device and opening only with negative pressure on the side of the reservoir, the aperture opening in a pressure-dependent manner wherein ambient air from the surrounding atmosphere flows through the aperture and into the reservoir;

wherein the housing is produced as a one-piece injection molded part from at least two plastics having different properties, wherein:

the coupling device consists of a first of the two plastics; and the ring seal; and/or the venting valve, consists of the second of the two plastics;

wherein:

the one-piece injection molded part which forms the housing has a return spring made of plastic, wherein by means of the return spring:

force is applied to the actuating handle in the direction of an unactuated starting position; and/or force is applied to a piston of a pump chamber of the conveying device in the direction of an enlargement of the pump chamber, the piston being operatively connected to the actuating handle and movable relative to the housing.

7. The applicator head as claimed in claim 6, wherein the return spring consists of the second of the two plastics.

8. The applicator head as claimed in claim 6, wherein the coupling device is formed as a detent coupling device designed to engage behind a widened portion on a neck of the reservoir, or the coupling device is formed as a threaded coupling device designed to cooperate with a thread on a neck of the reservoir.

9. An applicator head for coupling to a reservoir for discharging liquid or paste-like medium from the reservoir, comprising:

a housing with a coupling device for coupling to the reservoir;

an inlet opening facing the reservoir and an applicator opening for dispensing the medium into a surrounding atmosphere;

a conveying device for conveying the medium from the inlet opening to the applicator opening;

an actuating handle manually movable relative to the housing in order to actuate the conveying device;

wherein the housing is produced as a one-piece injection molded part from at least two plastics having different properties, wherein:

the coupling device consists of a first of the two plastics; and a ring seal surrounding the inlet opening and arranged in such a way that the ring seal bears tightly against the reservoir once the reservoir has been coupled to the applicator head; and/or a venting valve formed by a curved surface with a slot-shaped aperture that opens in a pressure-dependent manner and ambient air from the surrounding atmosphere flows through the slot-shaped aperture and into the reservoir, consists of the second of the two plastics.

10. The applicator head as claimed in claim 9, wherein the coupling device is formed as a detent coupling device, which is designed to engage behind a widened portion on a neck of the reservoir, or the coupling device is formed as a threaded coupling device designed to cooperate with a thread on a neck of the reservoir.

11. The applicator head as claimed in claim 9, wherein the housing additionally comprises a guide surface for guiding the actuating handle relative to the housing; and/or a cylinder surrounding a pump chamber and a piston operatively coupled to the actuating handle is movable in a sliding manner relative to the cylinder.

12. An applicator head for coupling to a reservoir for discharging liquid or paste-like medium from the reservoir, the applicator head comprising:

a housing with a coupling device for coupling to the reservoir;

an inlet opening facing the reservoir and an applicator opening for dispensing the medium into a surrounding atmosphere;

a conveying device for conveying the medium from the inlet opening to the applicator opening;

an actuating handle manually movable relative to the housing in order to actuate the conveying device;

wherein the housing is produced as a one-piece injection molded part from at least two plastics having different properties, wherein:

the coupling device consists of a first of the two plastics; and a ring seal surrounding the inlet opening and arranged in such a way that the ring seal bears tightly against the reservoir once the reservoir has been coupled to the applicator head; and/or a venting valve with an aperture that opens in a pressure-dependent manner and ambient air from the surrounding atmosphere flows through the aperture and into the reservoir, consists of the second of the two plastics, wherein:

the one-piece injection molded part which forms the housing has a return spring made of plastic, wherein by means of the return spring:

force is applied to the actuating handle in the direction of an unactuated starting position; and/or force is applied to a piston of a pump chamber of the conveying device in the direction of an enlargement of the pump chamber, the piston being operatively connected to the actuating handle and movable relative to the housing.

13. The applicator housing as claimed in claim 12, wherein the return spring consists of the second of the two plastics.

14. The applicator head as claimed in claim 12, wherein an outer surface of the actuating handle intended for direct user contact consists of the second of the two plastics.

15. An applicator head for coupling to a reservoir for discharging liquid or paste-like medium from the reservoir, the applicator head comprising:

a housing with a coupling device for coupling to the reservoir;

an inlet opening facing the reservoir and an applicator opening for dispensing the medium into a surrounding atmosphere;

a conveying device for conveying the medium from the inlet opening to the applicator opening;

an actuating handle manually movable relative to the housing in order to actuate the conveying device; and a one-piece component produced as an injection molded part from two plastics having different properties, the one-piece component on the one hand forming the actuating handle and/or a piston of the conveying device, and on the other hand forming a spring acting as a return spring between the actuating handle and/or the piston on the one hand and the housing on the other hand, wherein at least one guide surface of the actuating handle for guiding the actuating handle relative to the housing and/or at least one slide seal surface of the piston for sealing a pump chamber is fabricated from a first of the two plastics and the spring is fabricated from a second of the two plastics.

* * * * *